US010513940B2

(12) United States Patent
Granberg et al.

(10) Patent No.: US 10,513,940 B2
(45) Date of Patent: Dec. 24, 2019

(54) TURBOMACHINE WITH AN OUTER SEALING AND USE OF THE TURBOMACHINE

(71) Applicant: Siemens Aktiengesellschaft, Munich (DE)

(72) Inventors: Per Granberg, Norsholm (SE); Janos Szijarto, Finspong (SE)

(73) Assignee: Siemens Aktiengesellschaft, Munich (DE)

( * ) Notice: Subject to any disclaimer, the term of this patent is extended or adjusted under 35 U.S.C. 154(b) by 330 days.

(21) Appl. No.: 15/315,780

(22) PCT Filed: Jun. 23, 2015

(86) PCT No.: PCT/EP2015/064127
§ 371 (c)(1),
(2) Date: Dec. 2, 2016

(87) PCT Pub. No.: WO2015/197626
PCT Pub. Date: Dec. 30, 2015

(65) Prior Publication Data

US 2017/0159475 A1 Jun. 8, 2017

(30) Foreign Application Priority Data

Jun. 26, 2014 (EP) ..... 14174585

(51) Int. Cl.
*F01D 11/00* (2006.01)
*F01D 9/04* (2006.01)
(Continued)

(52) U.S. Cl.
CPC ..... *F01D 11/005* (2013.01); *F01D 5/02* (2013.01); *F01D 9/041* (2013.01); *F01D 25/246* (2013.01);
(Continued)

(58) Field of Classification Search
CPC ..... F01D 11/005; F01D 5/02; F01D 9/041; F01D 25/246; F01D 11/00; F01D 9/04; F05D 2220/32; F05D 2240/35
(Continued)

(56) References Cited

U.S. PATENT DOCUMENTS 3,529,906 A * 9/1970 Borden ..... F01D 11/005 415/180
4,314,793 A * 2/1982 DeTolla ..... F01D 11/005 415/135
(Continued)

FOREIGN PATENT DOCUMENTS

CN 102575526 A 7/2012
EP 0731254 A1 9/1996
EP 1323896 A2 7/2003

OTHER PUBLICATIONS

International Search Report dated Nov. 17, 2015, for PCT patent application No. PCT/EP2015/064127 (previously submitted).
(Continued)

*Primary Examiner* — David Hamaoui
*Assistant Examiner* — John D Bailey
(74) *Attorney, Agent, or Firm* — Beusse Wolter Sanks & Maire

(57) ABSTRACT

A turbomachine having a stator with at least one stator component and a rotor with at least one rotatable rotor component. The stator component defines at least one wall of a cooling cavity with a high pressure area of the turbomachine and the stator and the rotor defining a working media fluid path, the working media fluid path being in a low pressure area of the turbomachine, whereby a pressure of the low pressure area is lower than a pressure of the high pressure area and the low pressure area and the high pressure area are separated by a sealing ring, the sealing ring being
(Continued)

an annular ring with a diaphragm at an inner end of the annular ring.

12 Claims, 3 Drawing Sheets

(51) Int. Cl.
*F01D 25/24* (2006.01)
*F01D 5/02* (2006.01)

(52) U.S. Cl.
CPC ..... *F05D 2220/32* (2013.01); *F05D 2240/35* (2013.01)

(58) Field of Classification Search
USPC ..... 415/139
See application file for complete search history.

(56) References Cited

U.S. PATENT DOCUMENTS 4,645,217 A 2/1987 Honeycutt, Jr. et al.
5,221,096 A * 6/1993 Heldreth ..... F01D 11/005 277/630
5,797,723 A 8/1998 Frost et al.
6,164,656 A * 12/2000 Frost ..... F01D 11/005 277/312
6,402,466 B1 * 6/2002 Burdgick ..... F01D 9/04 277/630
6,464,457 B1 * 10/2002 Morgan ..... F01D 11/005 277/630
6,637,752 B2 * 10/2003 Aksit ..... F01D 11/005 277/416
6,648,333 B2 * 11/2003 Aksit ..... F01D 11/005 277/316
6,682,300 B2 * 1/2004 Bolms ..... F01D 11/005 415/139
7,172,388 B2 * 2/2007 Synnott ..... F01D 11/003 277/637
7,217,089 B2 * 5/2007 Durocher ..... F01D 11/005 415/170.1
7,303,371 B2 * 12/2007 Oltmanns ..... F01D 11/001 415/191
8,641,371 B2 * 2/2014 Nakamura ..... F01D 11/18 415/139
2011/0052384 A1 * 3/2011 Shi ..... F01D 9/04 415/200
2012/0177489 A1 7/2012 Batt
2012/0195737 A1 8/2012 Butler

OTHER PUBLICATIONS

EP Search Report dated Jan. 12, 2015, for EP patent application No. 14174585.1.
CN Office Action dated Jun. 28, 2017, for CN patent application No. 201580030178.3.

* cited by examiner

TURBOMACHINE WITH AN OUTER SEALING AND USE OF THE TURBOMACHINE

CROSS REFERENCE TO RELATED APPLICATIONS

This application is the US National Stage of International Application No. PCT/EP2015/064127 filed Jun. 23, 2015, and claims the benefit thereof. The International Application claims the benefit of European Application No. EP14174585 filed Jun. 26, 2014. All of the applications are incorporated by reference herein in their entirety.

FIELD OF INVENTION

The present invention refers to a turbomachine with a sealing for separation of high pressure and low pressure areas of the turbomachine and a use of the turbomachine.

BACKGROUND OF INVENTION

A turbomachine, for instance a gas turbine or a steam turbine, is used for power generation. Such a turbomachine comprises a stator with at least one stator component and a rotor with at least one rotor component.

A rotor component of the rotor is an axial shaft with a plurality of rotor blades. The rotor blades are arranged annularly around the axial shaft.

Stator components are a (main) stator ring, a plurality of guide vanes—usually comprising aerofoils and platforms—for guiding working fluid or working media of the turbomachine (hot gas from a combustor in case of a gas turbine and superheated steam in case of a steam turbine) and a vane carrier ring for carrying the guide vanes. The stator ring and the rotor shaft are coaxially arranged to each other. The guide vanes are arranged annularly around the vane carrier ring.

The guide vanes assist in guiding the working fluid for the impingement of the working fluid on the rotor blades of the rotor.

The rotor comprises rotatable rotor components.

Between rotor parts and stator parts annular openings may be present that need to be sealed. Also between adjacent stator parts sealing may be needed.

A variety of different sealing solutions are known, as disclosed for example in U.S. Pat. No. 4,314,793, EP 0 731 254 A1, EP 1 323 896 A2, or U.S. Pat. No. 6,164,656.

SUMMARY OF THE INVENTION

It is an object of the invention to provide a turbomachine in which the rotatable rotor components can nearly unhindered rotate and that a good sealing effect is provided.

A further object of the invention is the use of the turbomachine.

These objects are achieved by the invention specified in the claims.

A turbomachine is provided which comprises a stator with at least one stator component and a rotor with at least one rotatable rotor component. The stator component defines at least one wall of a cooling cavity with a high pressure area of the turbomachine and the stator and the rotor define a working media fluid path, the working media fluid path being a low pressure area of the turbomachine, whereby a pressure of the low pressure area is lower than a pressure of the high pressure area and the low pressure area and the high pressure area are separated by a sealing ring, the sealing ring being an annular ring with a diaphragm at an inner end of the annular ring.

For instance, the rotatable rotor component of the rotor is an axial shaft of the rotor with a plurality of rotor blades. The rotor blades are arranged annularly around the axial shaft. The stator components are a stator ring and/or a plurality of guide vanes for guiding working fluid of the turbomachine.

This turbomachine is used for producing electricity by leading the working fluid to rotor blades of the. For that, the rotor is coupled to at least one generator.

The respective components can be located completely in their respective areas. But it is also possible that these components border the respective areas. So, they are just partly located in the respective areas. A pressure of the different pressure areas can be about 20 bar. A pressure difference between the different pressure areas can be quite low, for instance just 1 bar for a first stage of a multi-stage turbomachine. In addition, there could be a secondary cooling system with resulting in a secondary pressure difference.

The diaphragm according to the invention is advantageously a flexible membrane.

Advantageously the stator component is a stator ring. The stator ring surrounds the rotatable rotor component. The sealing ring is located between the stator ring and the rotatable rotor component or to seal a gap between two stator parts. Thereby, at least two different pressure areas of turbomachine result. These different pressure areas are separated by the sealing ring. The high pressure area of the turbomachine surrounds the low pressure area of the turbomachine.

For instance, the low pressure area comprises at least one working fluid channel through which working fluid of the turbomachine can be led. In case of a gas turbine, the working fluid is hot gas of a gas turbine or—in case of a steam turbine—superheated steam of a steam turbine. The hot gas of the gas turbine comprises exhaust gases of a burning process (oxidation of a fuel). A temperature of the hot gas reaches temperatures of more than 1000° C.

In the following the invention is explained mainly for a gas turbine engine, but the invention can also be applied to a steam turbine accordingly.

The high pressure area of the turbomachine comprises advantageously at least one cooling channel with coolant fluid. The coolant fluid is advantageously air. With the aid of the coolant fluid the stator component is cooled.

In an embodiment the stator comprises at least one further stator component which defines a further wall of the high pressure area, wherein the further stator component is a guide vane and the guide vane and the stator ring are in physical contact only via the sealing ring. No direct connection of the guide vane and the stator ring is present. An annular gap between the guide vane and the stator ring is sealed by the sealing ring. By this solution stator ring, guide vanes and the sealing ring form a unity.

Advantageously, the sealing ring is fixed to the stator ring with the aid of a fastening element. Particularly, the fastening element may be the sole point of fixation of the sealing ring.

The fastening element can be formed by a weld. In an embodiment, the fastening element is a screw. With the aid of the screw the stator ring and the sealing ring form a screwed construction. Stator ring and sealing ring are screwed together such that stator ring and guide vanes are bordering at least partly the high pressure area. Advantageously, many screws are used for the fixing the sealing ring and the stator ring along the circumference of the stator. The screws are arranged along the circumference of the sealing ring and the stator ring, respectively.

In an embodiment the annular gap between the sealing ring and the guide vane is sealed with the aid of a frictional engagement, the frictional engagement is advantageously the mentioned diaphragm.

Advantageously, a sealing strip is arranged between sealing ring and the guide vane for an improvement of the frictional engagement.

The sealing ring is developed such that the sealing ring can slide against the guide vane. So, both components are merely in physical contact but not physically fixed together.

Advantageously, the sealing ring can be developed such that the sealing ring can slide against an annular flange of the guide vane.

Advantageously, the sealing ring can act as a disc spring in axial direction of the rotatable rotor component or of an adjacent section of the stator, particularly a combustion chamber exit section (spring function). The sealing ring is formed and located between the high pressures area and the low pressure area such that the spring function in the axial direction is caused by the pressure difference between high pressure area and the low pressure area or due to different thermal expansion of the different components. Such a system is quite simple.

In addition, the rotation of the rotatable rotor component is not hindered by the sealing ring.

Besides, the diaphragm may be sized to accommodate axial thermal displacement of the stator component and the further stator component due to different thermal expansion of the stator component and the further stator component.

BRIEF DESCRIPTION OF THE DRAWINGS

Further features and advantages of the invention are produced from the description of an exemplary embodiment with reference to the drawings. The drawings are schematic.

DETAILED DESCRIPTION OF THE INVENTION

Figure 1:
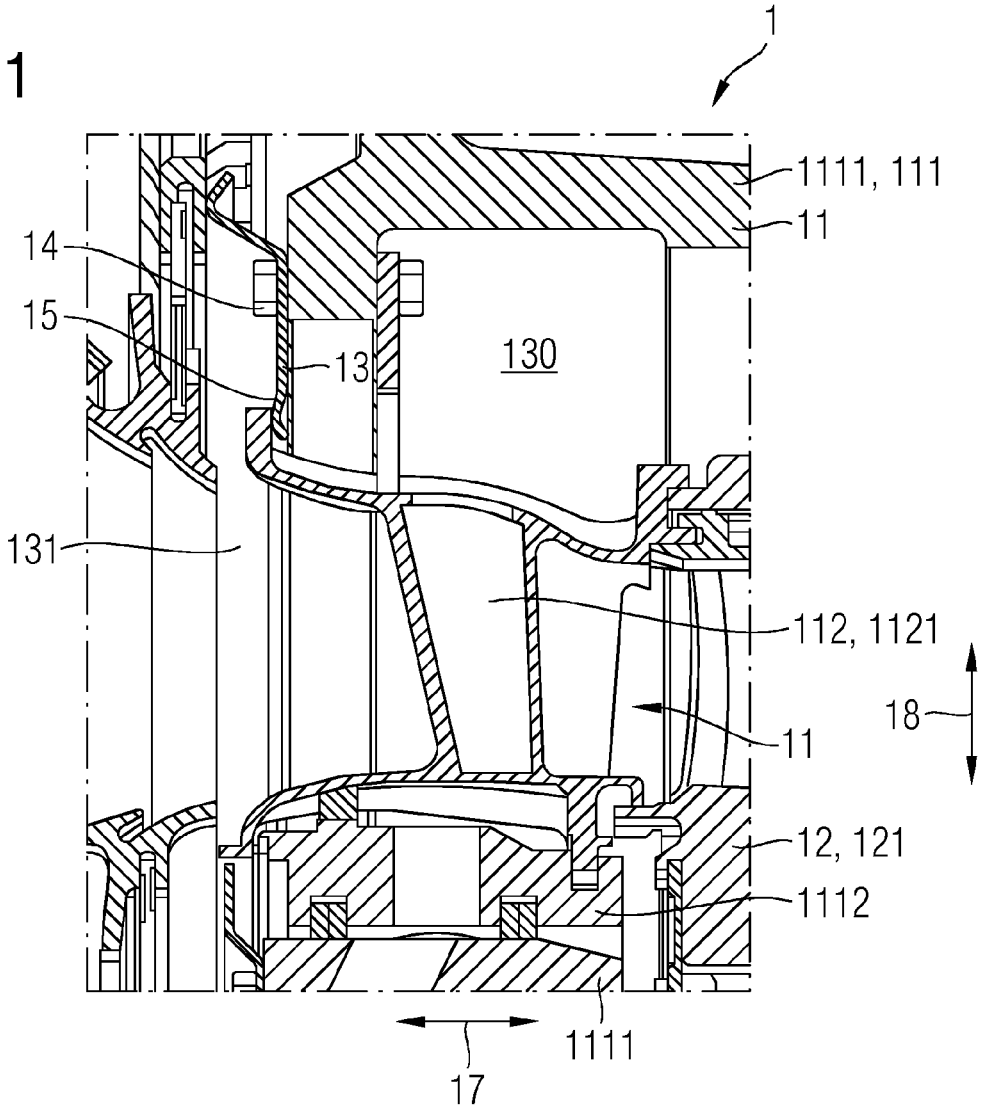
FIG. 1 shows a first cross section of a turbomachine.

Exemplarily, a turbomachine 1 is given. The turbomachine 1 is a gas turbine in the given figures. The turbomachine 1 comprises a stator 11 with stator components 111. Stator components 111 are an annular main stator ring 1111, an annular vane carrier ring 1112 and guide vanes 1121, among others.

An axial direction of the turbomachine 1 (of the rotatable rotor component 121) is shown by reference 17. Reference 17 also indicates axial thermal expansion of stator components during operation. A radial direction of the turbomachine 1 is shown by reference 18. Reference 18 also indicates radial thermal expansion of stator components during operation.

In FIG. 1, a flow direction of a main working media would be from left (where the reference symbol 131 is depicted) to right (where reference symbol 11 is shown), substantially oriented in direction of the reference symbol 17.

The turbomachine 1 comprises additionally a rotor 12 with at least one rotatable rotor component 121. The rotatable rotor component 121 is an axial rotor shaft on which rotor blades are arranged for driving the rotor shaft. The rotor shaft, the vane carrier ring 1112 and main stator ring 1111 are coaxially arranged to each other.

The turbomachine 1 comprises multi stages. Within a first stage of the turbomachine 1, the rotatable rotor component 121 is at least partly located in a low pressure area 131 of the turbomachine 1 whereas the stator component is providing also a separation from the low pressure area 131 to a high pressure area 130. The low pressure area 131 comprises the working fluid of the turbomachine 1. The working fluid is hot gas of a combustion process. The high pressure area 130 of the turbomachine 1 comprises a coolant fluid for cooling components of the turbomachine. The coolant fluid is air, typically provided from an upstream compressor.

The pressure of the low pressure area 131 is lower than a pressure of the high pressure area 130. The high pressure area 130 can surround, at least at some positions, the low pressure area 131.

For the embodiment of a gas turbine, the low pressure area 131 of about 19 bar comprises hot exhaust gas of a combustion process and the high pressure area 130 of about 20 bar comprises coolant fluid (air). The pressure difference is in this example about 1 bar. The high pressures area 130 and the low pressure area 131 are separated via a sealing ring 13.

In the stator 11 comprises at least one further stator component 112. Further stator components 112 are guide vanes 1121.

The guide vanes 1121 and the stator ring 1111 provide an annular gap or opening between each other and are sealed via the sealing ring 13. Thus, the sealing ring 13 closes the existing gap or opening.

The sealing ring 13 comprises Hastalloy X. In an alternative embodiment, the sealing ring 13 comprises the metal alloy IN717. The later material has the advantage that its elasticity is high. The resulting sealing ring 13 acts more like a spring.

The sealing ring 13 is fixed to the stator ring 1111 with the aid of fastening (fixing) elements 14. The fastening elements 14 are—according to FIG. 1—screws which are annularly arranged along the circumference of the sealing ring 13. With the aid of the screws 14 the stator ring 1111 and the sealing ring 13 are a screwed together. Thereby the stator ring 1111 and guide vanes 1121 form at least partly a common wall to the high pressure area 130 of the turbomachine 1.

Figure 4:
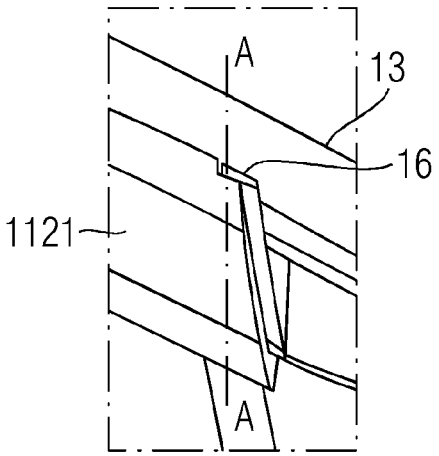
FIG. 4 shows a detail of FIG. 3.
Figure 5:
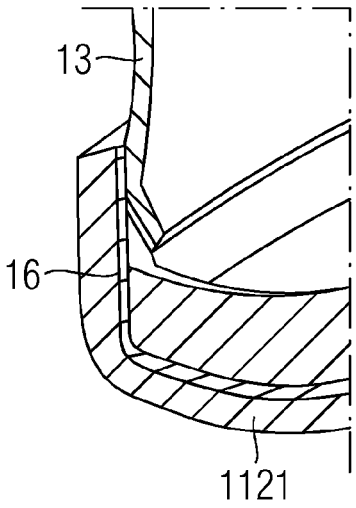
FIG. 5 shows a cross section along the connecting line A-A (FIG. 4).

The sealing ring 13 and the guide vanes 1121 are connected together with the aid of a frictional engagement 15. A sealing strip 16—see FIGS. 4 and 5—is arranged between sealing ring 13 and the respective guide vanes 1121 for an improvement of the frictional engagement 15. The sealing ring 13 is developed such that the sealing ring 13 can slide against the guide vanes 1121. So, both the sealing ring 13 and the guide vanes 1121 are solvable fixed together. The sealing strip 16 may be a coating of a flange of the guide vane 1121, so that the friction is increased when the sealing ring 13 slides along a surface of the flange.

Figure 2:
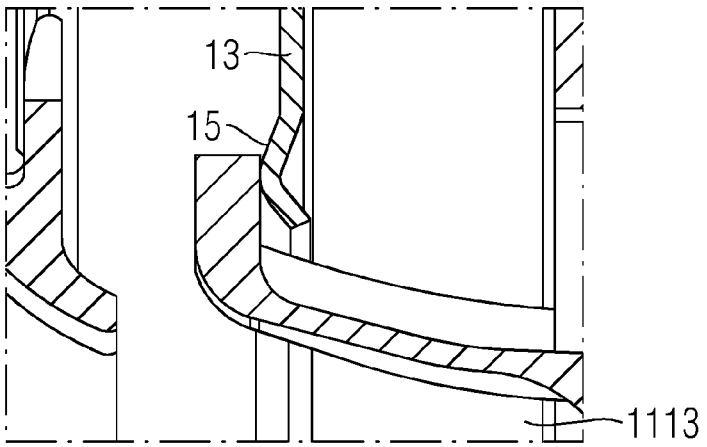
FIG. 2 shows a detail of FIG. 1.
Figure 3:
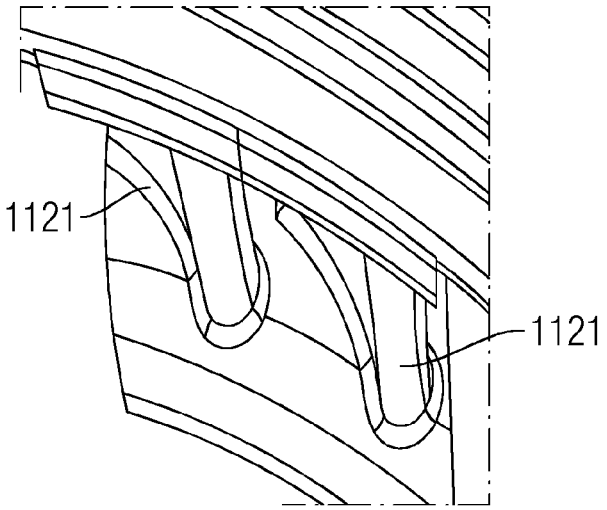
FIG. 3 shows a second cross section of the turbomachine.

The invention is particularly advantageous as the diaphragm—the part which is directed to by reference symbol 15 in FIG. 2—can compensation thermal displacements, particularly of the stator ring 1111 and an annular flange—which can be seen in detail in FIG. 2—of the guide vane 1121.

This turbomachine 1 is used for producing electricity by leading the working fluid to the rotor blades of the rotor through the working fluid channel. For the production of electricity the rotor is coupled to a generator.

The invention claimed is:

1. A turbomachine comprising:

a stator comprising a stator component;

a rotor comprising a rotatable rotor component;

wherein the stator component defines at least one wall of a cooling cavity comprising a high pressure area of the turbomachine;

wherein the stator and the rotor define a working media fluid path, the working media fluid path being a low pressure area of the turbomachine;

wherein a pressure of the low pressure area is lower than a pressure of the high pressure area; and a sealing ring, wherein the low pressure area and the high pressure area are separated via the sealing ring, the sealing ring being an annular ring comprising a diaphragm at an inner end of the annular ring, wherein the stator component comprises a stator ring, wherein the stator comprises a further stator component which defines a further wall of the high pressure area, wherein the further stator component is a guide vane;

wherein an annular gap between the guide vane and the stator ring is sealed by the sealing ring;

wherein the annular gap between the sealing ring and the guide vane is sealed with the aid of a frictional engagement; and wherein the diaphragm comprises an axially oriented protrusion from the sealing ring, and wherein a peak of the axially oriented protrusion provides the frictional engagement.

2. The turbomachine according to claim 1, further comprising:

a fastening element, wherein the sealing ring is fixed to the stator ring with the aid of the fastening element.

3. The turbomachine according to claim 2, wherein the fastening element is a screw.

4. The turbomachine, according to claim 1, wherein the sealing ring is developed such that the sealing ring is slidable against an annular flange of the guide vane.

5. The turbomachine according to claim 4, further comprising:

a sealing strip arranged between the sealing ring and the annular flange of the guide vane.

6. The turbomachine according to claim 1, wherein the sealing ring acts as a disc spring in axial direction of the rotatable rotor component or of an adjacent section of the stator.

7. The turbomachine according to claim 1, wherein the diaphragm is sized to accommodate axial thermal displacement of the stator component and the further stator component due to different thermal expansion of the stator component and the further stator component.

8. A method for producing electricity, comprising:

leading a working fluid to rotor blades of a rotor of a turbomachine according to claim 1.

9. The turbomachine according to claim 2, wherein the fastening element is the sole point of fixation of the sealing ring.

10. The turbomachine according to claim 6, wherein the adjacent section of the stator is a combustion chamber exit section.

11. A turbomachine, comprising:

a stator comprising a stator ring;

a stator vane comprising a flange;

a sealing ring comprising a radially outer end secured to the stator ring and a radially inner end;

a rotor;

a working media fluid path defined by the stator and the rotor;

a cooling cavity bounded radially by the stator ring and the stator vane, and bounded at an axially upstream end by the sealing ring;

wherein a greater pressure in the cooling cavity than in the working media fluid path urges the radially inner end of the sealing ring axially upstream into frictional contact with the flange of the stator vane, and wherein the frictional contact provides a seal between the cooling cavity and the working media fluid path.

12. The turbomachine of claim 11, wherein the radially inner end of the sealing ring comprises a diaphragm comprising a protrusion oriented axially upstream, and wherein a peak of the protrusion contacts the flange of the stator vane to form the frictional contact and the seal.

* * * * *